US008197003B2

(12) United States Patent
Rogers

(10) Patent No.: US 8,197,003 B2
(45) Date of Patent: Jun. 12, 2012

(54) CONVERTIBLE SEATING DEVICE

(76) Inventor: Dwight C. Rogers, San Diego, CA (US)

( * ) Notice: Subject to any disclaimer, the term of this patent is extended or adjusted under 35 U.S.C. 154(b) by 282 days.

(21) Appl. No.: 12/565,659

(22) Filed: Sep. 23, 2009

(65) Prior Publication Data

US 2011/0068610 A1 Mar. 24, 2011

(51) Int. Cl.
*A47C 3/02* (2006.01)
*A47C 13/00* (2006.01)

(52) U.S. Cl. ..... 297/258.1; 297/130

(58) Field of Classification Search ..... 297/130, 297/131, 258.1, 440.11, 440.14, 440.23
See application file for complete search history.

(56) References Cited

U.S. PATENT DOCUMENTS

| | | | | | |
|---|---|---|---|---|---|
| 191,733 | A | | 6/1877 | True | |
| 326,241 | A | * | 9/1885 | Preston | 297/131 |
| 326,968 | A | | 9/1885 | Gibson | |
| 480,636 | A | * | 8/1892 | Stevens | 297/132 |
| 685,509 | A | | 10/1901 | Dutton | |
| 902,395 | A | | 10/1908 | Haley | |
| 1,026,276 | A | | 5/1912 | Moskowits | |
| 1,353,066 | A | * | 9/1920 | Pascoe | 297/3 |
| 2,407,839 | A | | 9/1946 | Lemos | |
| 2,494,045 | A | * | 1/1950 | Kauffman | 297/131 |
| 2,587,881 | A | | 3/1952 | Oakes | |
| 2,709,479 | A | | 5/1955 | Rieger | |
| 2,776,700 | A | | 1/1957 | Potter et al. | |
| 3,001,822 | A | | 9/1961 | Pagliaro et al. | |
| 3,233,942 | A | | 2/1966 | Creutz | |
| 3,570,418 | A | | 3/1971 | Gooding | |
| 3,650,563 | A | * | 3/1972 | Hansson et al. | 297/440.11 |
| 3,899,208 | A | * | 8/1975 | Cirigliano | 297/271.5 |
| 3,985,460 | A | * | 10/1976 | Piper et al. | 403/234 |
| 4,035,020 | A | * | 7/1977 | Gold | 297/271.5 |
| 4,160,564 | A | * | 7/1979 | Kyle | 297/131 |
| 4,205,876 | A | | 6/1980 | Cetina | |
| D265,868 | S | * | 8/1982 | Holschneider | D6/335 |
| 5,104,179 | A | | 4/1992 | Jones | |
| 5,415,454 | A | | 5/1995 | Fu-Tsung | |
| 5,634,687 | A | | 6/1997 | Gamble | |
| 6,367,874 | B2 | | 4/2002 | Casini | |
| 6,695,408 | B1 | * | 2/2004 | Nobbe | 297/440.11 |

* cited by examiner

*Primary Examiner* — Sarah B McPartlin
(74) *Attorney, Agent, or Firm* — Charles F. Reidelbach, Jr., Esq.

(57) ABSTRACT

A seating device includes a pair of side supports. Each side support includes a first arm rest that functions as a rocker runner in a rocker configuration and a second arm rest that functions as a stationary runner in a stationary configuration. A seat is fastened to the side supports. A rocker lateral support is fastened to the side supports above the seat. A stationary lateral support is fastened to the side supports below the seat. A back rest pivots inside the seat to an upright position against the rocker lateral support when the side supports are configured in the rocker configuration and to an upright position against the stationary lateral support when the side supports are configured in the stationary configuration.

15 Claims, 13 Drawing Sheets

CONVERTIBLE SEATING DEVICE

BACKGROUND OF THE INVENTION

1. Field of the Invention

The present invention is directed generally to an article of furniture. More specifically, but without limitation thereto, the present invention is directed to a seating device that may be converted between a stationary configuration and a rocker configuration.

2. Description of Related Art

Adjustable chairs that convert from a stationary chair to a rocking chair provide much of the functionality of two chairs in the floor space required for only one chair. Also, the cost of a convertible chair is typically significantly less than that of a stationary chair and a rocking chair.

SUMMARY OF THE INVENTION

In one embodiment, a seating device includes a pair of side supports. Each side support includes a first arm rest that functions as a rocker runner in a rocker configuration and a second arm rest that functions as a stationary runner in a stationary configuration. A seat is fastened to the side supports. A rocker lateral support is fastened to the side supports above the seat. A stationary lateral support is fastened to the side supports below the seat. A back rest pivots inside the seat to an upright position against the rocker lateral support when the side supports are configured in the rocker configuration and to an upright position against the stationary lateral support when the side supports are configured in the stationary configuration.

BRIEF DESCRIPTION OF THE DRAWINGS

The above and other aspects, features and advantages will become more apparent from the description in conjunction with the following drawings presented by way of example and not limitation, wherein identical reference indicia in separate views indicate the same elements and the same combinations of elements throughout the drawings, and wherein.

Elements in the figures are illustrated for simplicity and clarity and have not necessarily been drawn to scale. For example, the dimensions of some elements in the figures may be exaggerated relative to other elements, and some elements and features of some elements may be omitted in certain views to facilitate illustration and explanation of various embodiments within the scope of the appended claims. Accordingly, indicia that reference a specific element or a specific combination of elements in any view explicitly include by reference all the features shown for that element or combination of elements referenced by the same indicia in all the views.

DETAILED DESCRIPTION OF THE ILLUSTRATED EMBODIMENTS

The following description is not to be taken in a limiting sense, rather for the purpose of describing by specific examples the general principles that are incorporated into the illustrated embodiments. For example, certain actions or steps may be described or depicted by way of example to be performed in a specific order without excluding performing the described steps in another order or arrangement to achieve substantially the same result. Also, the terms and expressions used in the description have the ordinary meanings accorded to such terms and expressions in the corresponding respective areas of inquiry and study except where other meanings have been specifically set forth herein.

Figure 1:
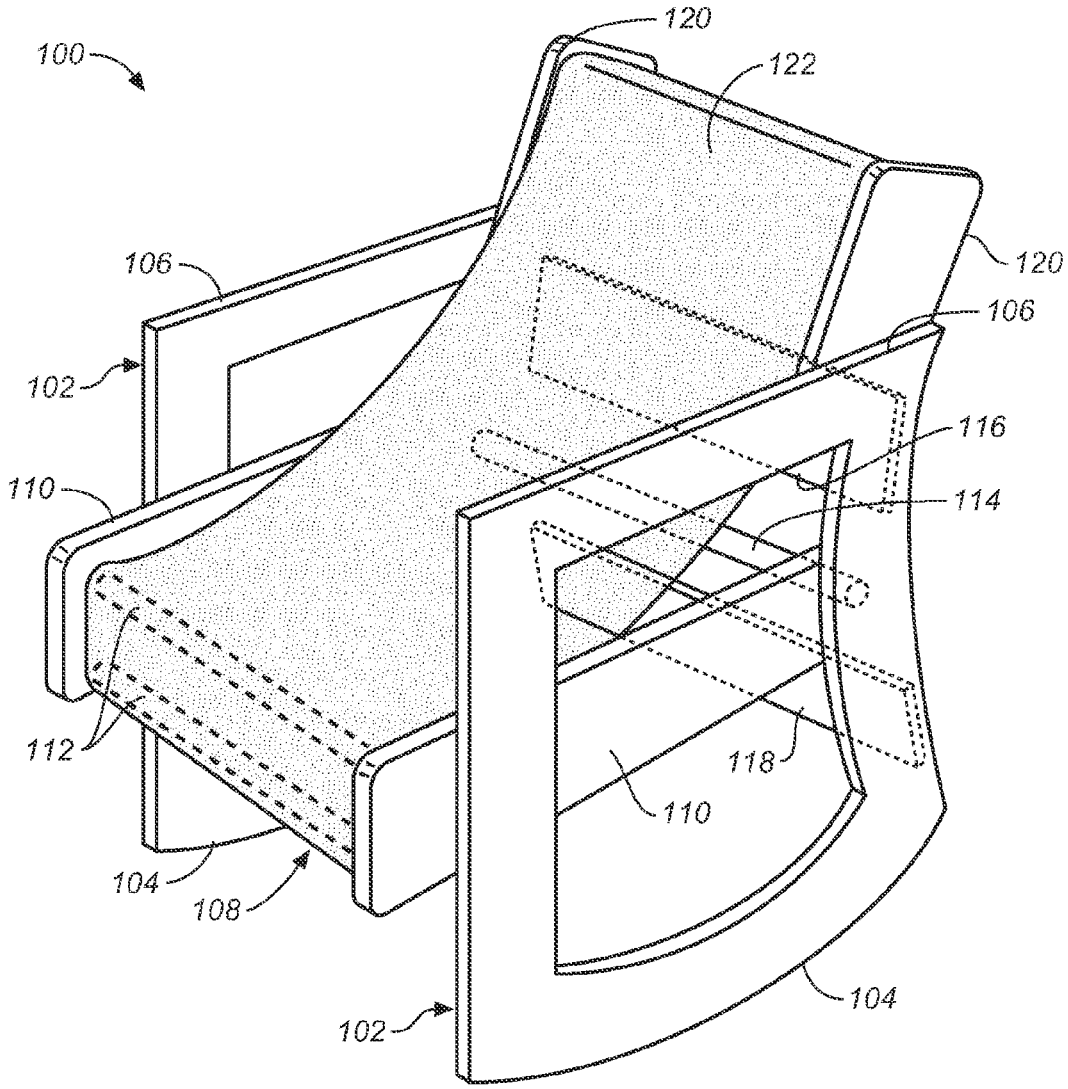
FIG. 1 illustrates a perspective view of an embodiment of a convertible seating device in a rocker configuration.

FIG. 1 illustrates a perspective view of an embodiment of a convertible seating device 100 in the rocker configuration. Shown in FIG. 1 are side supports 102, arm rests 104 and 106, a seat 108, seat side pieces 110, an outer seat support 112, an inner seat support 114, a rocker lateral support 116, a stationary lateral support 118, a back rest 120, and a cover 122.

In FIG. 1, each of the side supports 102 includes the arm rests 104 and 106. The arm rests 104 have an arcuate shape that function as rocker runners in the rocker configuration, that is, when the side supports 102 are positioned so that the arm rests 104 are below the arm rests 106. The arm rests 106 have a straight shape that function as stationary runners in the stationary configuration, that is, when the side supports 102 are positioned so that the arm rests 106 are below the arm rests 104. The seat 108 includes the seat side pieces 110, the outer seat support 112, and the inner seat support 114. The seat side pieces 110 are fastened between the side supports 102. The outer seat support 112 includes, for example, one or more dowels fastened between the seat side pieces 110 inside the front portion of the seat 108. A vertical distance between the dowels is selected to create a dimensional difference between the top dowel and arm rests 104, 106, respectively, and the top dowel and floor, to provide optimal user comfort in either the stationary or rocker configuration. The inner seat support 114 includes, for example, one or more dowels fastened between the seat side pieces 110 inside the back portion of the seat 108. The rocker lateral support 116 is fastened between the side supports 102 above the seat 108. The stationary lateral support 118 is fastened between the side supports 102 below the seat 108.

In various embodiments, the seat 108, the rocker lateral support 116, the stationary lateral support 118, and the side supports 102 are made of wood, metal, plastic or other rigid material according to well-known techniques to form a rigid structure. The cover 122 is a length of flexible material formed into a loop around the seat 108 outside the outer seat support 112 and the back rest 120. In various embodiments, the cover 122 is made of one or more layers of a fabric such as canvas or other material suitable for covering chairs.

Figure 2:
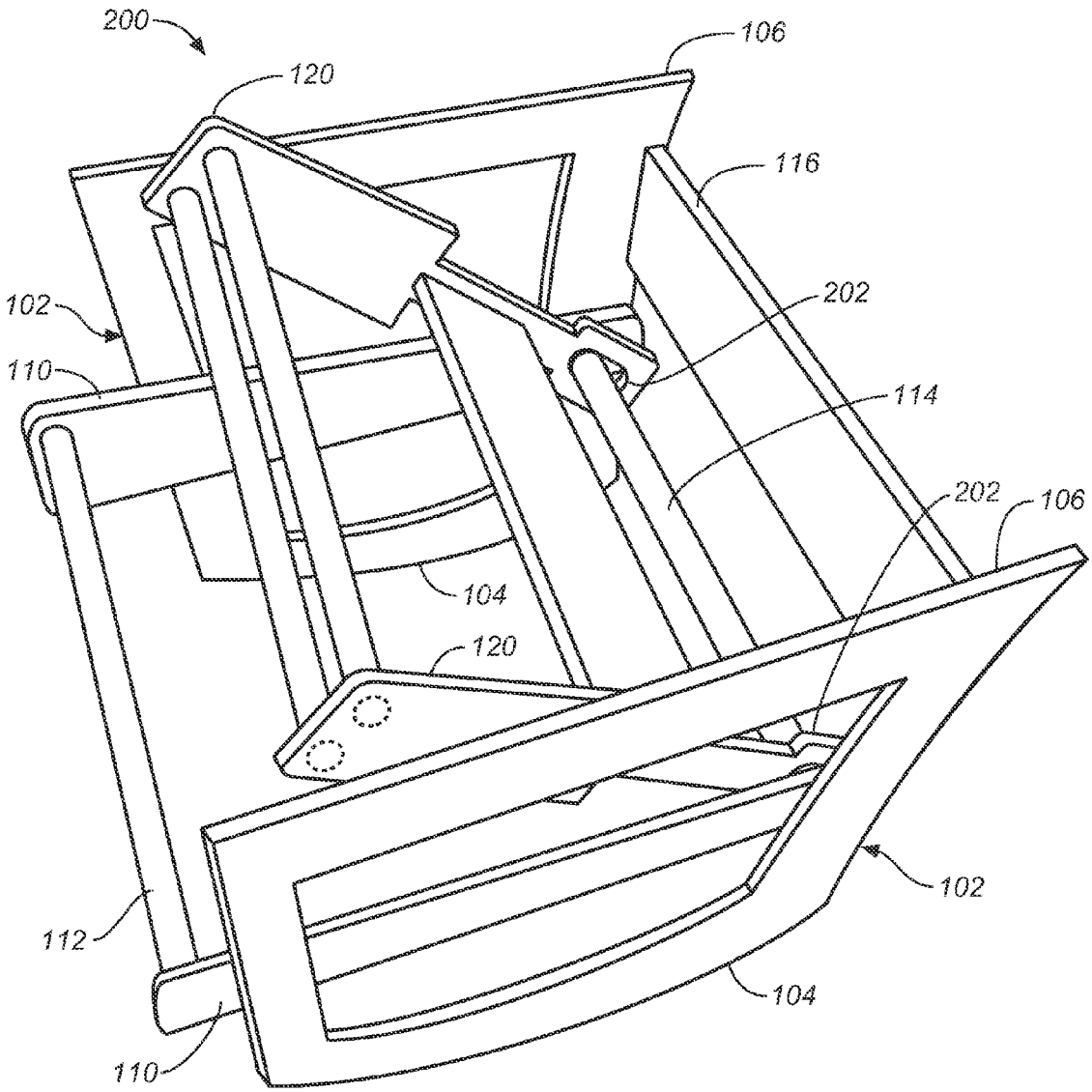
FIG. 2 illustrates a close-up view of a back rest for the convertible seating device of FIG. 1.

FIG. 2 illustrates a close-up view 200 of a back rest for the convertible seating device 100 of FIG. 1. Shown in FIG. 2 are side supports 102, seat side pieces 110, an inner seat support 114, a rocker lateral support 116, a back rest 120, a cover 122, and pivot slots 202.

In FIG. 2, the back rest 120 includes the pivot slots 202. In various embodiments, the back rest 120 is made of wood, metal, plastic or other rigid material to pivot inside the seat 108 on the inner seat support 114 that extends through the pivot slots 202 between the seat side pieces 110. The back rest 120 pivots to the upright position against the rocker lateral support 116 when the side supports 102 are configured in the rocker configuration and pivots to the upright position against the stationary lateral support 118 when the side supports 102 are configured in the stationary configuration.

In one embodiment, the back rest 120 pivots inside the seat side pieces 110 on the inner seat support 114 against the side of the rocker lateral support 116 facing the seat 108. The cover 122 is formed in a loop around the back rest 120 so that the cover 122 covers the front side of the seat 108 and the back rest 120 in both the rocker configuration and the stationary configuration.

Figure 3:
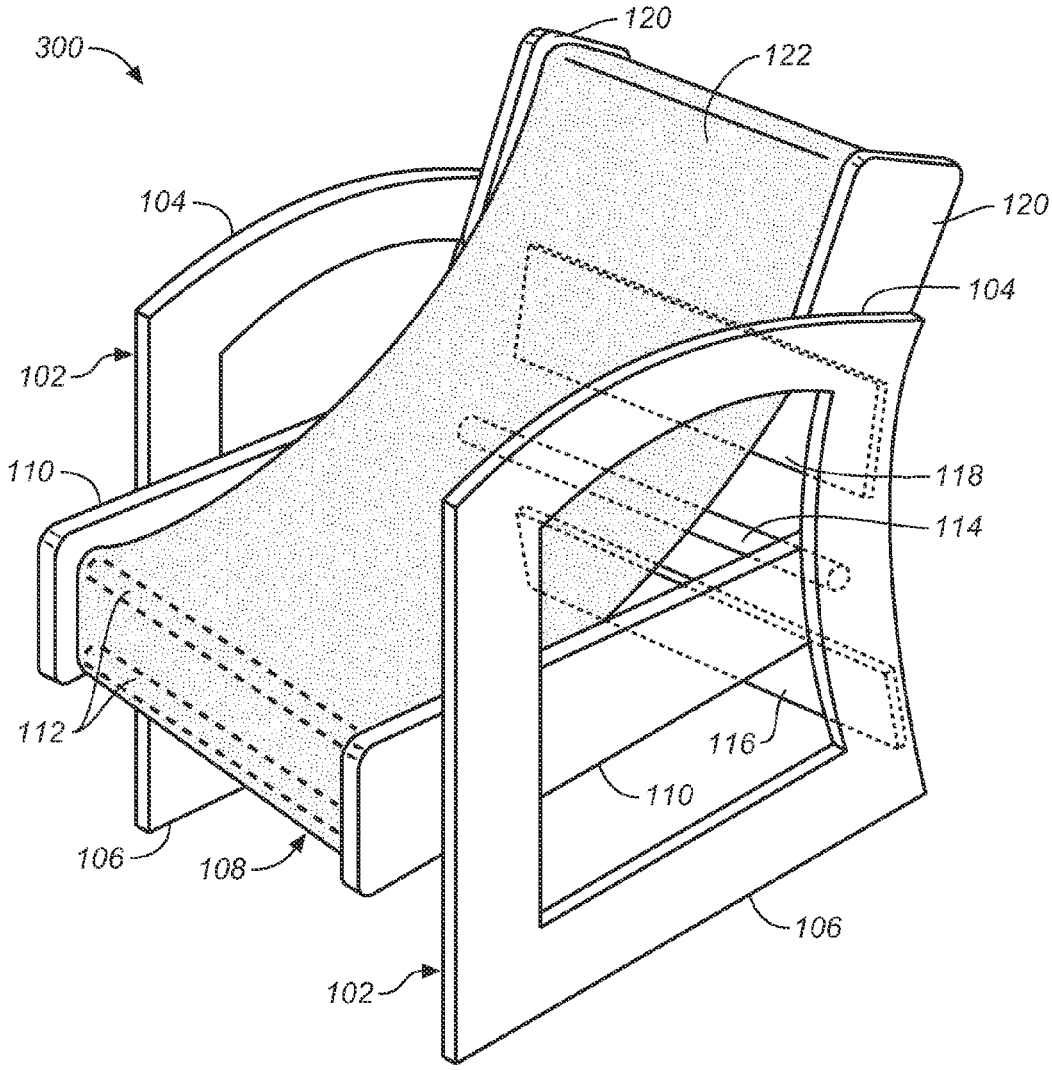
FIG. 3 illustrates a perspective view of the convertible seating device of FIG. 1 in a stationary configuration.

FIG. 3 illustrates a perspective view 300 of the convertible seating device 100 of FIG. 1 in the stationary configuration. Shown in FIG. 3 are side supports 102, arm rests 104 and 106, a seat 108, seat side pieces 110, an inner seat support 114, a rocker lateral support 116, a stationary lateral support 118, a back rest 120, and a cover 122.

In FIG. 3, the convertible seating device 100 is configured from the rocker configuration in FIG. 1 to the stationary configuration by pivoting the back rest 120 inside the seat 108 between the seat side pieces 110 as described above with regard to FIG. 2, inverting the convertible seating device 100 to place the arm rests 106 on the floor, and pivoting the back rest 120 to the upright position against the stationary lateral support 118. To convert the convertible seating device 100 to the rocker configuration, the back rest 120 is pivoted inside the seat 108 between the seat side pieces 110. The convertible seating device 100 is inverted to place the arm rests 104 on the floor, and the back rest 120 is pivoted to the upright position against the rocker lateral support 116.

Figure 4:
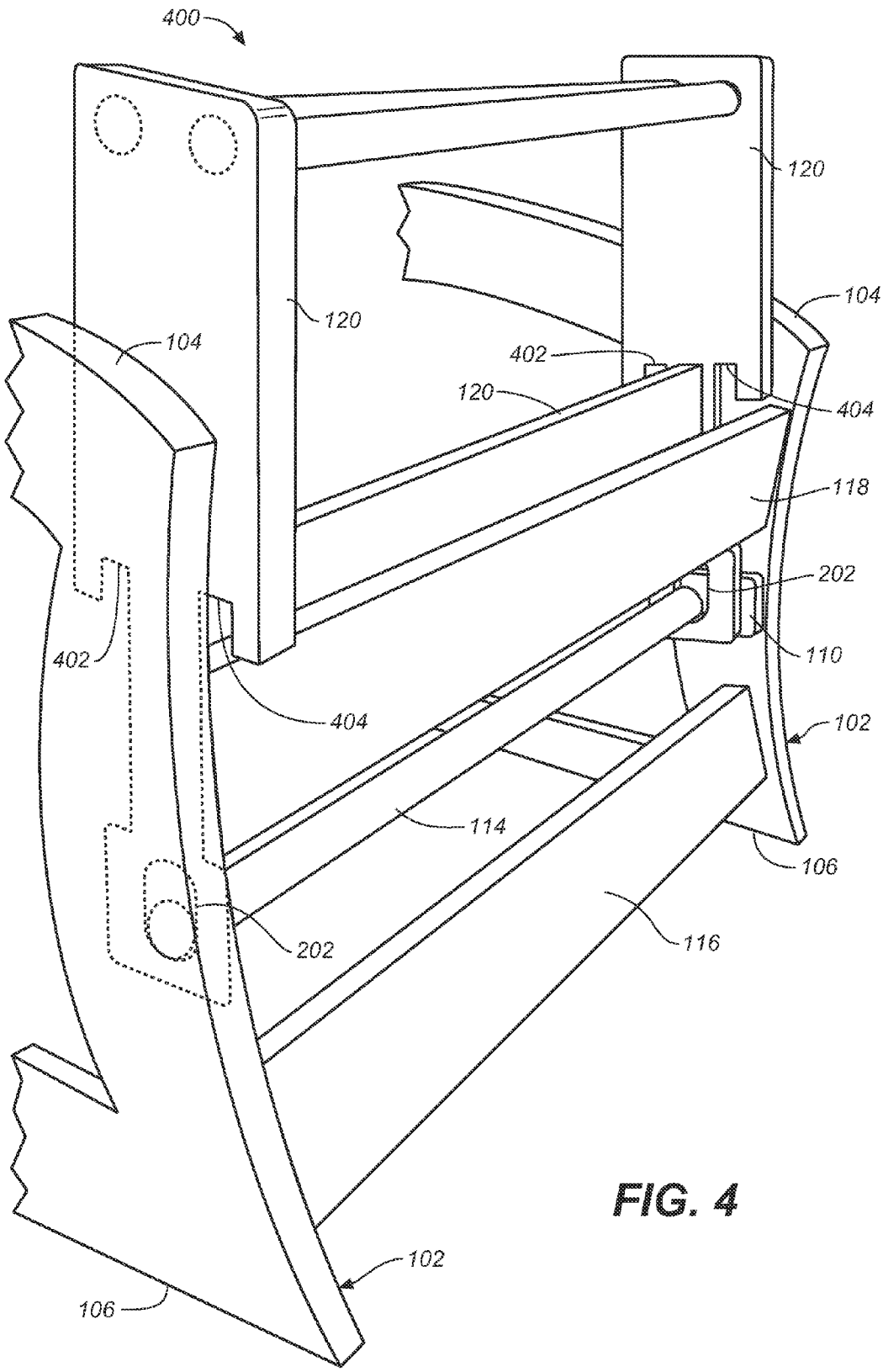
FIG. 4 illustrates a close-up rear view of the back rest of FIG. 3 including locking grooves for interlocking with the front side of the stationary lateral support.

FIG. 4 illustrates a close-up rear view 400 of the back rest of FIG. 3 including locking grooves for interlocking with the front side of the stationary lateral support. Shown in FIG. 4 are a side support 102, arm rests 104 and 106, seat side pieces 110, an inner seat support 114, a rocker lateral support 116, a stationary lateral support 118, a back rest 120, pivot slots 202, and locking grooves 402 and 404.

In FIG. 4, the back rest 120 includes the pivot slots 202 and the locking grooves 402 and 404. The back rest 120 pivots between the seat side pieces 110 on the inner seat support 114 that extends through the pivot slots 202. The pivot slots 202 allow the back rest 120 to slide on the inner seat support 114 so that the locking grooves 404 are positioned over the top edge of the stationary lateral support 118.

Figure 5:
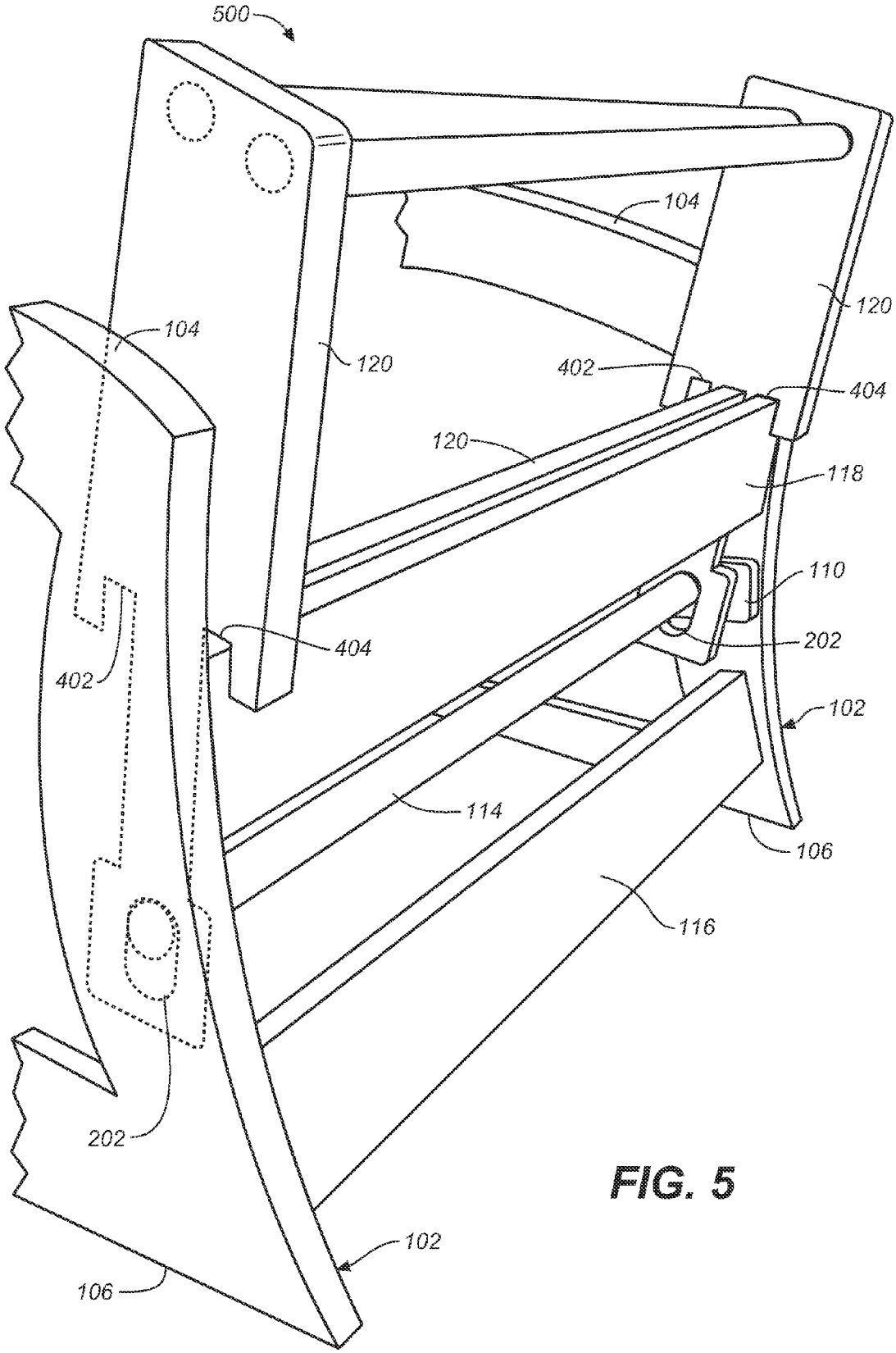
FIG. 5 illustrates a close-up rear view of the back rest of FIG. 3 after interlocking with the front side of the stationary lateral support.

FIG. 5 illustrates a close-up rear view of the back rest of FIG. 4 after interlocking with the front side of the stationary lateral support. Shown in FIG. 5 are side supports 102, arm rests 104 and 106, seat side pieces 110, an inner seat support 114, a rocker lateral support 116, a stationary lateral support 118, a back rest 120, pivot slots 202, and locking grooves 402 and 404.

In FIG. 5, the back rest 120 slides on the pivot slots 202 to engage and disengage the locking grooves 404 with top edge of the stationary lateral support 118, interlocking and unlocking the back rest 120 and the stationary lateral support 118 in the stationary configuration. In the rocker configuration, the locking grooves 402 interlock and unlock the back rest 120 and the rocker lateral support 116 in the same manner.

FIGS. 5A, 5B, 5C, and 5D illustrate a series of side views that show how the seating device of FIG. 1 is converted between the stationary configuration and the rocker configuration. Shown in FIGS. 5A, 5B, 5C, and 5D are arm rests 104 and 106, seat side pieces 110, an inner seat support 114, a rocker lateral support 116, a stationary lateral support 118, a back rest 120, and a cover 122.

Figure 5A:
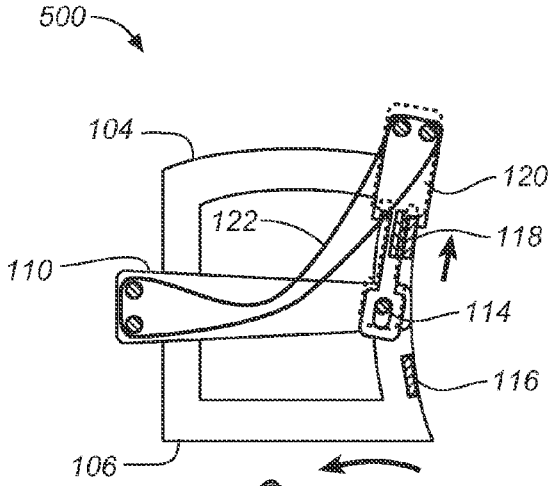
FIGS. 5A, 5B, 5C, and 5D illustrate a series of side views that show how the seating device of FIG. 1 is converted between the stationary configuration and the rocker configuration.

In FIG. 5A, the back rest 120 slides out on the inner seat support 114 to unlock the back rest 120 from the stationary lateral support 118.

Figure 5B:
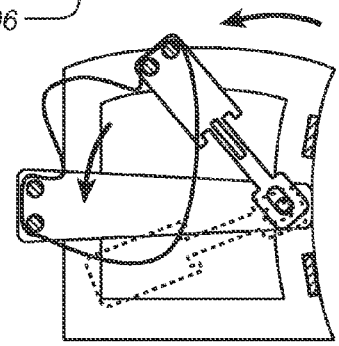

In FIG. 5B, the back rest 120 pivots on the inner seat support 114 inside the seat side pieces 110.

Figure 5C:
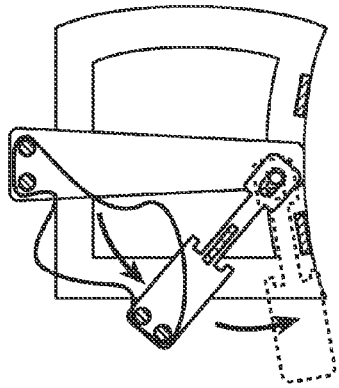

In FIG. 5C, the back rest 120 continues pivoting on the inner seat support 114 to the rocker lateral support 116.

Figure 5D:
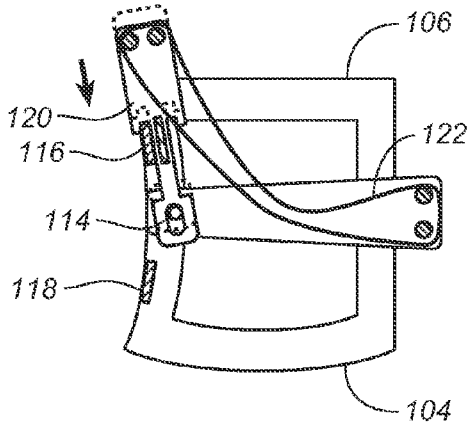

In FIG. 5D, the chair is inverted and the back rest 120 slides down on the inner seat support 114, locking the back rest 120 and the rocker lateral support 116. The steps shown in FIGS. 5A, 5B, 5C, and 5D are reversed to convert the seating device of FIG. 1 from the rocker configuration to the stationary configuration.

Figure 6:
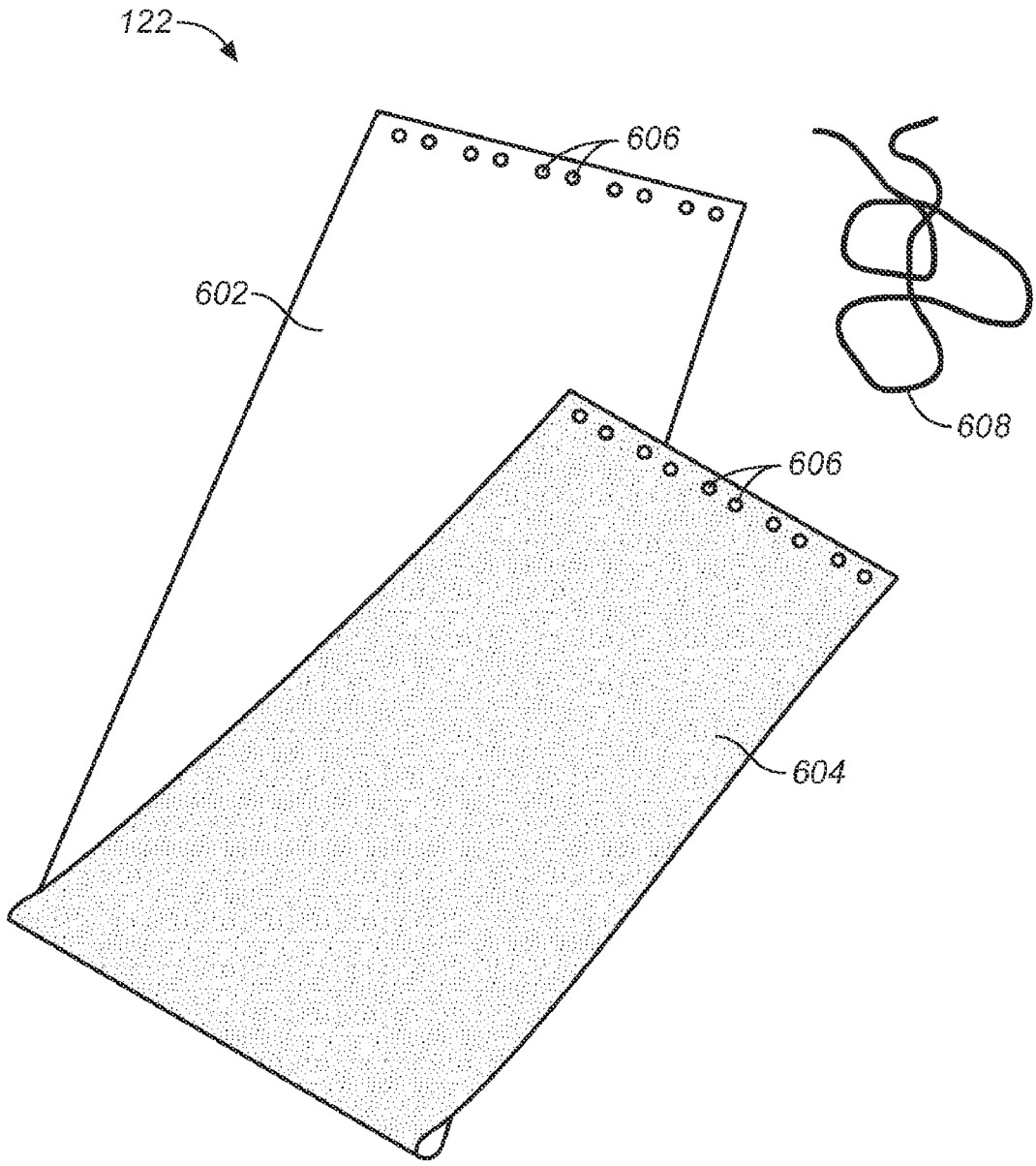
FIG. 6 illustrates a disassembled view of a cover for the convertible seating device of FIG. 1.

FIG. 6 illustrates a disassembled view of a cover 122 for the convertible seating device 100 of FIG. 1. Shown in FIG. 6 are opposite surfaces 602 and 604, grommets 606, and lacing 608.

In FIG. 6, the cover 122 is made of a length of a flexible material such as canvas or a similar fabric. In other embodiments, the cover 122 is made from any of a variety of flexible materials that may be used to cover chairs. The cover 122 is fastened along each of the opposite ends of the length of flexible material, for example, by the grommets 606 and the lacing 608 according to well-known techniques to form a loop. In other embodiments, the opposite ends of the cover 122 are fastened by various means according to well-known techniques to form a loop.

In the embodiment of FIG. 6, two lengths of fabric are fastened at the edges according to well-known techniques to make the reversible surfaces 602 and 604. In various embodiments, the reversible surfaces 602 and 604 differ from each other in at least one of color, pattern, and texture.

Figure 7:
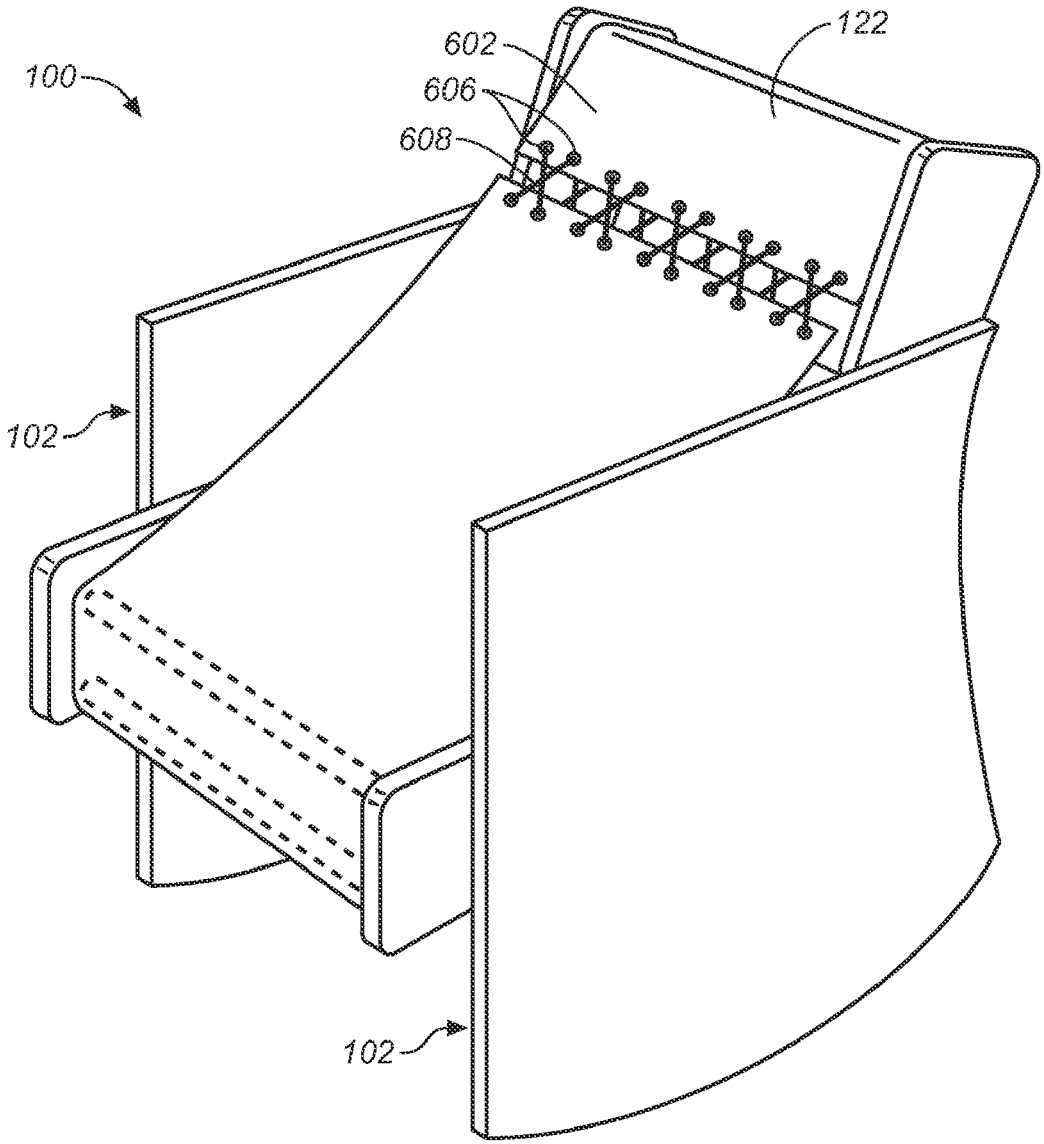
FIG. 7 illustrates a perspective view of the cover of FIG. 6 with the convertible seating device.

FIG. 7 illustrates a perspective view of the cover of FIG. 6 with the convertible seating device. Shown in FIG. 7 are a convertible seating device 100, side supports 102, a cover 122, grommets 606, and lacing 608.

In FIG. 7, the convertible seating device 100 is made in the same manner as described above with regard to FIG. 1, except with smaller proportions, for example, in a child's chair. Preferably, the side supports 102 in this embodiment are created as a result of the fabrication of the larger-sized side supports 106, 107 shown in FIG. 1, and are formed as solid panels having the same outer shape as in FIG. 1. The lacing 608 that fastens the cover 122 by the grommets 606 is shown in the front of the convertible seating device 100, where the grommets 606 are easily accessible for lacing the cover 122 into a loop.

Figure 8:
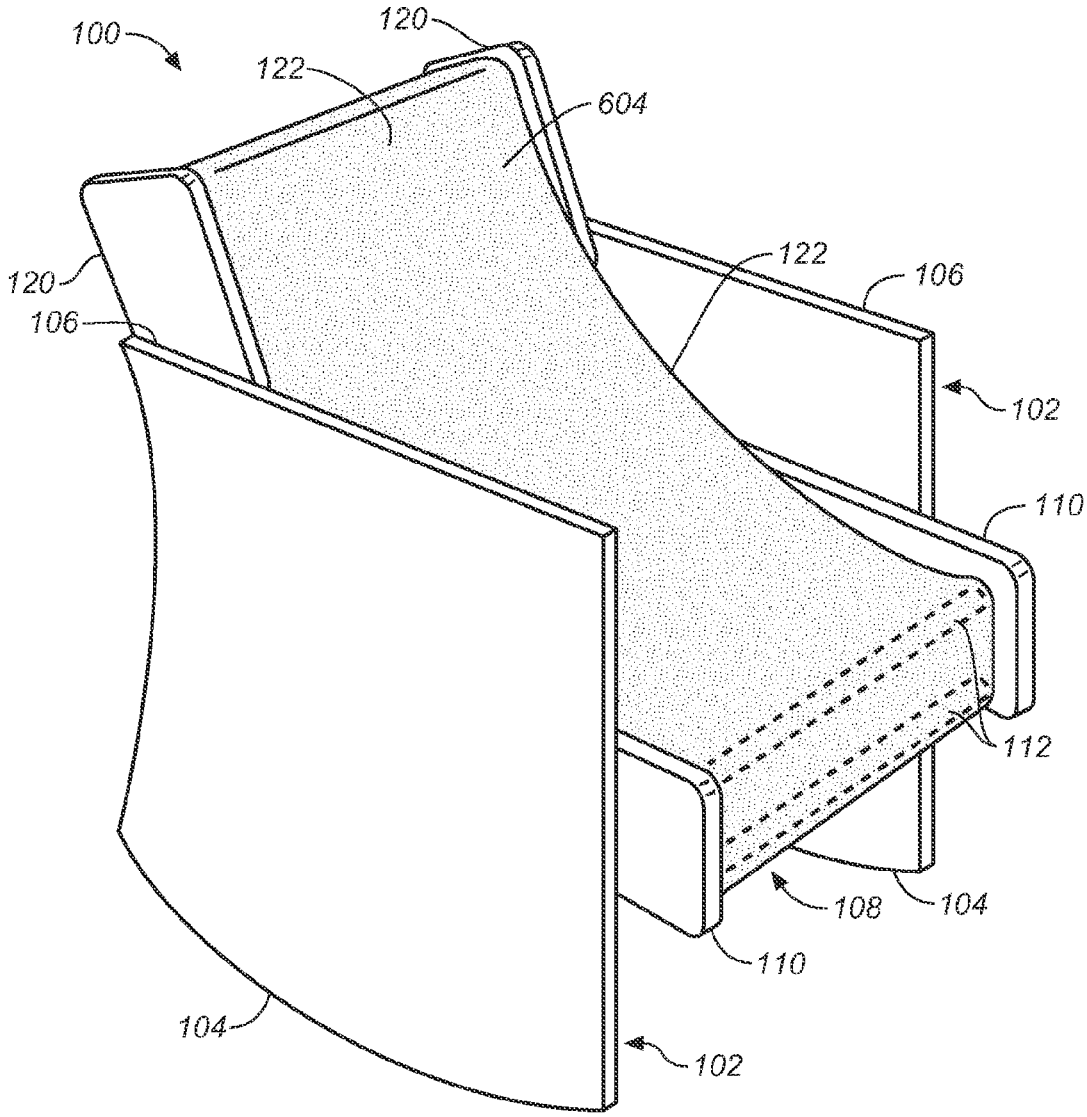
FIG. 8 illustrates a perspective view of an embodiment of the convertible seating device of FIG. 7 in the rocker configuration with the cover reversed.

FIG. 8 illustrates a perspective view of an embodiment of the convertible seating device 100 of FIG. 7 in the rocker configuration with the cover reversed. Shown in FIG. 7 are side supports 102, arm rests 104 and 106, a seat 108, seat side pieces 110, an outer seat support 112, a back rest 120, and a cover 122.

In FIG. 8, the cover 122 has been reversed to position the patterned side of the cover 122 on the outside of the loop around the back rest 120. After lacing the cover 122 into a loop around the seat 108 and the back rest 120, the cover 122 can slide over the back rest 120 to move the lacing out of sight behind the convertible seating device 100.

Figure 9:
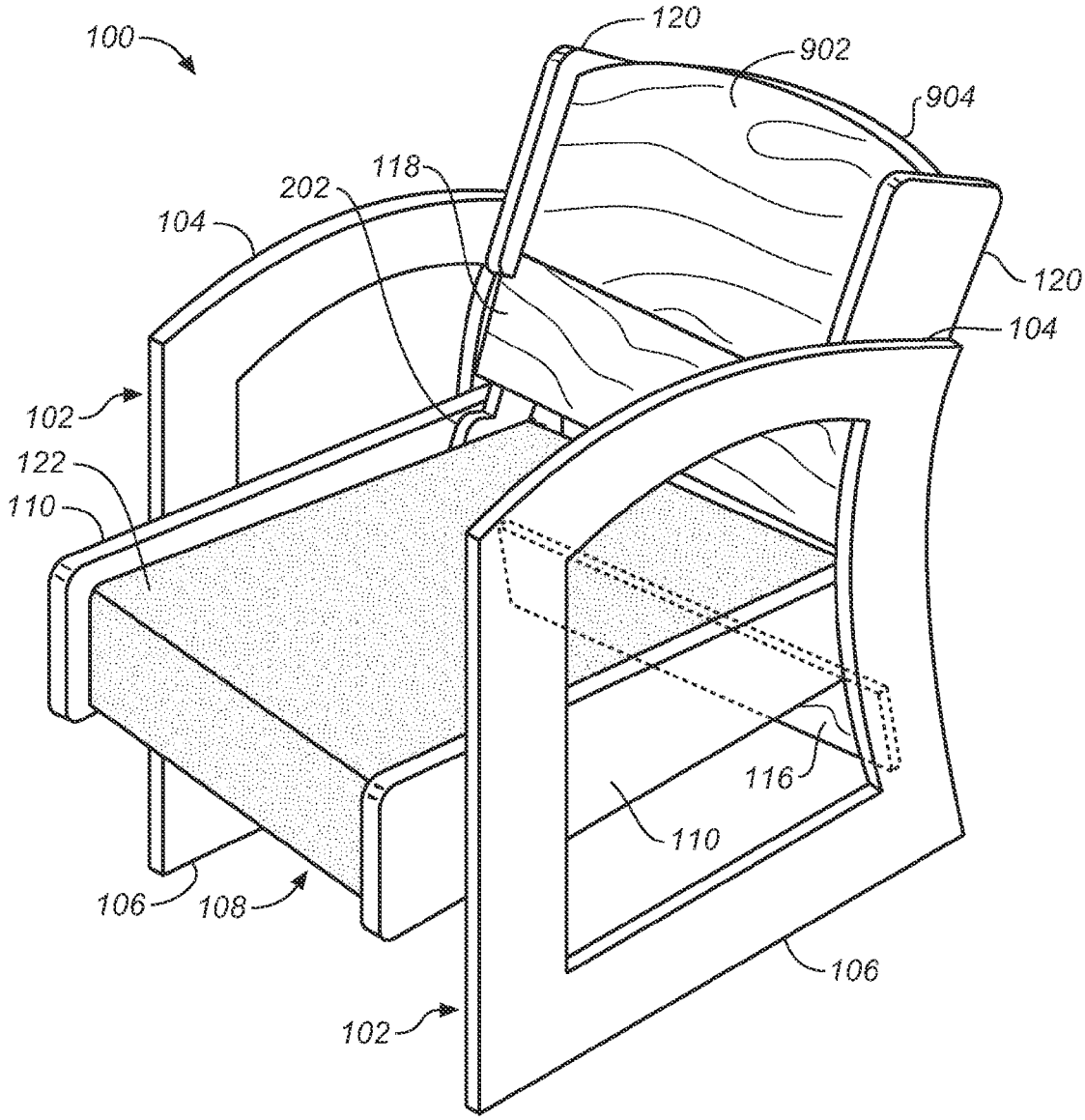
FIG. 9 illustrates a perspective view of an embodiment of the convertible seating device of FIG. 1 in the stationary configuration with a double-sided back rest.

FIG. 9 illustrates a perspective view of an embodiment of the convertible seating device of FIG. 1 in the stationary configuration with a double-sided back rest. Shown in FIG. 9 are side supports 102, arm rests 104 and 106, a seat 108, seat side pieces 110, a rocker lateral support 116, a stationary lateral support 118, a back rest 120, a cover 122, a pivot slot 202, and back panels 902 and 904.

In FIG. 9, the back rest 120 includes the back panels 902 and 904 on the front and rear sides of the back rest 120. In various embodiments, the back panels 902 and 904 are made of a solid material, for example, wood, metal, or plastic. In other embodiments, the back panels 902 and 904 are upholstered according to well-known techniques with a fabric and padding. In a further embodiment, the back panels 902 and 904 are combined into a single panel. In another embodiment, the cover 122 is formed in a loop around the seat 108 so that the cover 122 covers the seat 108 in both the rocker configuration and the stationary configuration.

In one embodiment, the back rest 120 pivots away from the back side of the rocker lateral support 116 to an upright position against the back side of the stationary lateral support 118 in the stationary configuration and pivots away from the back side of the stationary lateral support 118 to an upright position against the back side of the rocker lateral support 116 in the rocker configuration.

By adding the back panels 902 and 904 to the back rest 120 and making the seat cover 122 in a shorter loop that fits around the seat 108, the embodiment of FIG. 1 may be converted to the double-sided back rest version in which the back rest 120 pivots backwards away from the seat 108 instead of forward and inside the seat side pieces 110 as in FIG. 4.

Figure 10:
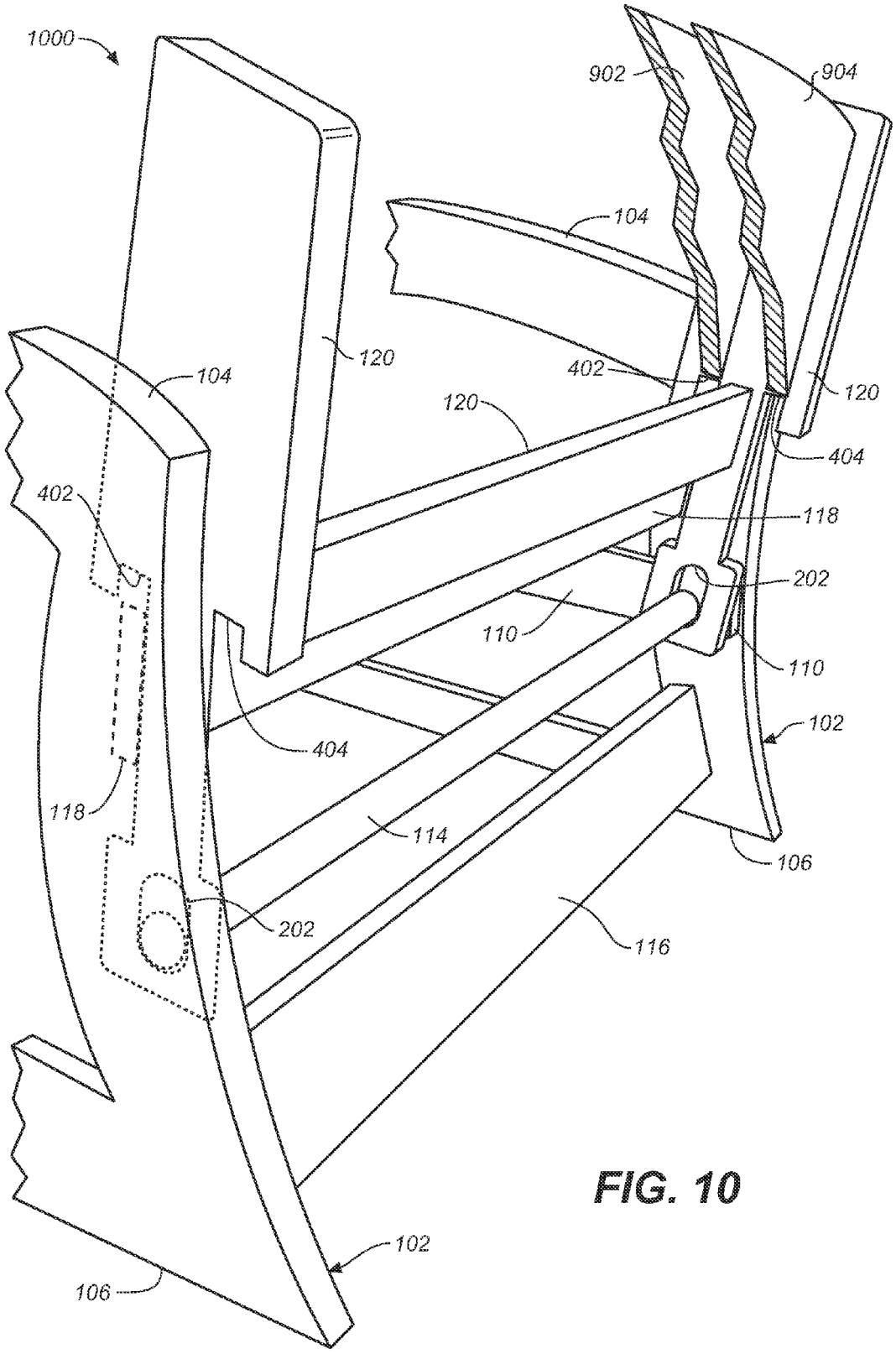
FIG. 10 illustrates a close-up view of the back rest for the convertible seating device of FIG. 9 including locking grooves for interlocking with the back side of the rocker lateral support.

FIG. 10 illustrates a close-up view 1000 of the back rest for the convertible seating device of FIG. 9 including locking grooves for interlocking with the back side of the rocker lateral support. Shown in FIG. 10 are side supports 102, seat side pieces 110, an inner seat support 114, a rocker lateral support 116, a stationary lateral support 118, a back rest 120, pivot slots 202, locking grooves 402 and 404, and back panels 902 and 904.

In FIG. 10, the back rest 120 pivots between the seat side pieces 110 on the inner seat support 114 that extends through the pivot slots 202. The pivot slots 202 allow the back rest 120 to slide out from the inner seat support 114 to position the locking grooves 402 over the top edge of the stationary lateral support 118.

Figure 11:
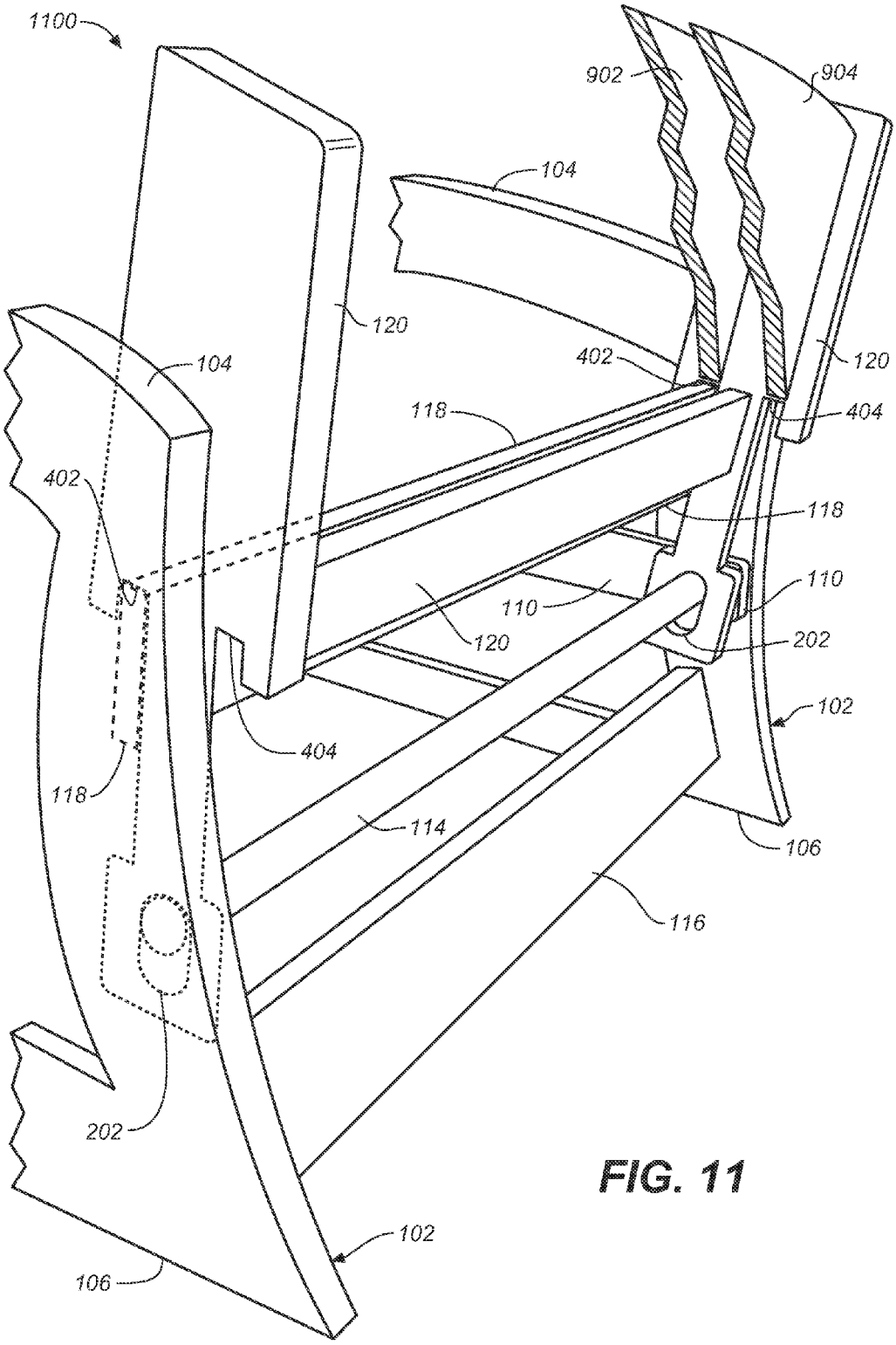
FIG. 11 illustrates a close-up view of the back rest of FIG. 10 after interlocking with the back side of the rocker lateral support.

FIG. 11 illustrates a close-up view 1100 of the back rest of FIG. 10 after interlocking with the back side of the rocker lateral support. Shown in FIG. 11 are side supports 102, arm rests 106, a seat 108, seat side pieces 110, an inner seat support 114, a rocker lateral support 116, a stationary lateral support 118, a back rest 120, pivot slots 202, locking grooves 402 and 404, and back panels 902 and 904.

In FIG. 11, the back rest 120 slides on the pivot slots 202 so that the locking grooves 402 engage the top edge of the stationary lateral support 118 to interlock and unlock the back rest 120 and the stationary lateral support 118 in the stationary configuration. In the rocker configuration, the locking grooves 404 interlock and unlock the back rest 120 and the rocker lateral support 116 in the same manner.

FIGS. 11A, 11B, 11C, and 11D illustrate a series of side views that show how the seating device of FIG. 9 is converted between the stationary configuration and the rocker configuration. Shown in FIGS. 11A, 11B, 11C, and 11D are arm rests 104 and 106, seat side pieces 110, an inner seat support 114, a rocker lateral support 116, a stationary lateral support 118, and a back rest 120.

Figure 11A:
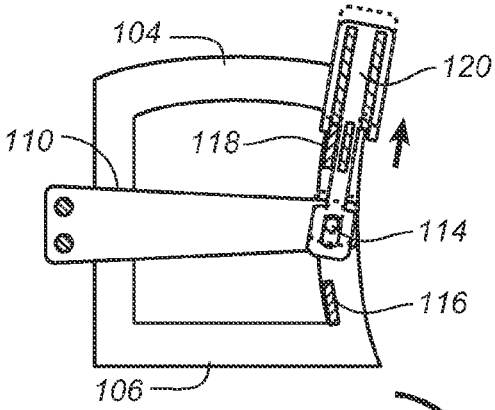
FIGS. 11A, 11B, 11C, and 11D illustrate a series of side views that show how the seating device of FIG. 9 is converted between the stationary configuration and the rocker configuration.

In FIG. 11A, the back rest 120 slides out on the inner seat support 114 to unlock the back rest 120 from the stationary lateral support 118.

Figure 11B:
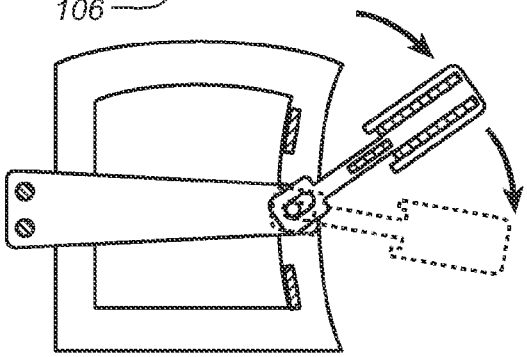

In FIG. 11B, the back rest 120 pivots on the inner seat support 114 behind the seat side pieces 110.

Figure 11C:
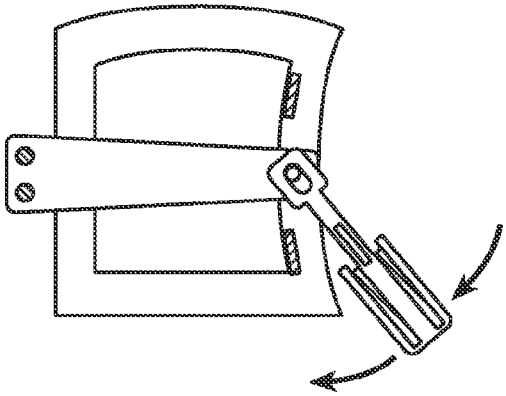

In FIG. 11C, the back rest 120 continues pivoting on the inner seat support 114 to the rocker lateral support 116.

Figure 11D:
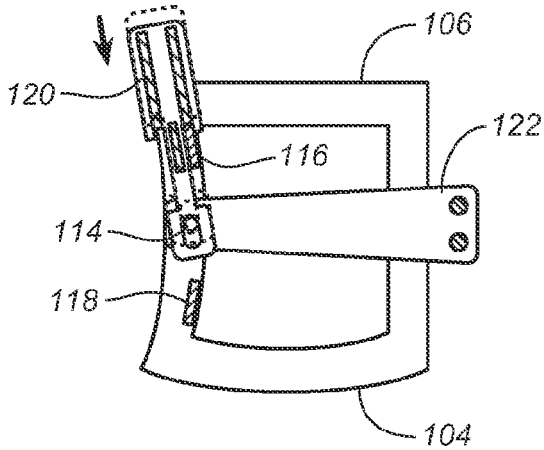

In FIG. 11D, the chair is inverted, and the back rest 120 slides down against the inner seat support 114 to lock the back rest 120 to the rocker lateral support 116. The steps in FIGS. 11A, 11B, 11C, and 11D are reversed to convert the seating device of FIG. 9 from the rocker configuration to the stationary configuration.

In the embodiments shown in the figures, the convertible seating device is proportioned as a chair. In other embodiments, the convertible seating device is proportioned according to well-known techniques to make a love seat, a sofa, and other seating devices within the scope of the appended claims.

The specific embodiments and applications thereof described above are for illustrative purposes only and do not preclude modifications and variations encompassed by the scope of the following claims.

What is claimed is:

1. A seating device comprising:

a pair of side supports, each side support comprising a first arm rest that functions as a rocker runner in a rocker configuration and a second arm rest that functions as a stationary runner in a stationary configuration;

a seat fastened to the side supports, the seat including side pieces fastened to the side supports, an outer seat support fastened between the side pieces at a front end of the seat, and an inner seat support fastened between the side pieces at a back end of the seat;

a rocker lateral support fastened to the side supports;

a stationary lateral support fastened to the side supports; and a back rest that pivots inside the seat to an upright position against the rocker lateral support when the side supports are configured in the rocker configuration and to an upright position against the stationary lateral support when the side supports are configured in the stationary configuration, the back rest including a locking groove for interlocking the back rest and the rocker lateral support when the side supports are configured in the rocker configuration and a slot for pivoting the back rest on the inner seat support and for sliding the back rest to interlock the back rest and the rocker lateral support in the locking groove.

2. The seating device of claim 1 further comprising a length of flexible material formed into a loop that covers the seat when the side supports are configured in the rocker configuration and when the side supports are configured in the stationary configuration.

3. The seating device of claim 2, the length of flexible material comprising a fabric.

4. The seating device of claim 2, the length of flexible material comprising opposite ends fastened together by lacing.

5. The seating device of claim 2, the length of flexible material comprising opposite surfaces that differ from each other in one of color, pattern, and texture.

6. The seating device of claim 1 further comprising a length of flexible material formed into a loop that covers the seat and the back rest when the side supports are configured in the rocker configuration and when the side supports are configured in the stationary configuration.

7. The seating device of claim 6, the length of flexible material comprising a fabric.

8. The seating device of claim 6, the length of flexible material comprising opposite ends fastened together by lacing.

9. The seating device of claim 6, the length of flexible material comprising opposite surfaces that differ in one of color, pattern, and texture.

10. The seating device of claim 1, the outer seat support comprising two vertically spaced dowels for supporting a loop of flexible material around the outer seat support and the inner seat support to cover the seat.

11. A seating device comprising:

a pair of side supports, each side support comprising a first arm rest that functions as a rocker runner in a rocker configuration and a second arm rest that functions as a stationary runner in a stationary configuration;

a seat fastened to the side supports the seat including side pieces fastened to the side supports, an outer seat support fastened between the side pieces at a front end of the seat;

an inner support fastened between the side supports;

a rocker lateral support fastened to the side supports;

a stationary lateral support fastened to the side supports; and a back rest that pivots to an upright position against the rocker lateral support when the side supports are configured in the rocker configuration and to an upright position against the stationary lateral support when the side supports are configured in the stationary configuration, the back rest including a locking groove for interlocking the back rest and one of the rocker lateral support and the stationary lateral support when the side supports are configured in one of the rocker configuration and the stationary configuration respectively, the back rest including a slot for pivoting the back rest on the inner support between the rocking configuration and the stationary configuration and to slide the back rest on the inner support to interlock the back rest and one of the rocker lateral support and the stationary lateral support in the locking groove.

12. The seating device of claim 11 wherein the locking groove includes two locking grooves including a first locking groove configured to lock to the rocker lateral support in the rocking configuration and a second locking groove to lock to the stationary lateral support in the stationary configuration.

13. The seating device of claim 12 wherein the two locking grooves are substantially symmetrical with respect to the back rest so that the two locking grooves interlock with the rocker lateral support and the stationary lateral support in the same manner.

14. The seating device of claim 11 wherein the back rest is configured to pivot between the side pieces of the seat between the rocker configuration and the stationary configuration.

15. The seating device of claim 11 wherein the back rest is configured to pivot behind the side pieces of the seat between the rocker configuration and the stationary configuration.

* * * * *